US006658675B1

(12) United States Patent
Terry

(10) Patent No.: US 6,658,675 B1
(45) Date of Patent: Dec. 9, 2003

(54) SUPPORT FOR IN-GROUND SWIMMING POOL PIPES

(76) Inventor: Michael T. Terry, 607 E. 3rd St., Lawton, MI (US) 49065

( * ) Notice: Subject to any disclaimer, the term of this patent is extended or adjusted under 35 U.S.C. 154(b) by 0 days.

(21) Appl. No.: 10/307,579

(22) Filed: Dec. 2, 2002

(51) Int. Cl.[7] ..... E04H 4/04

(52) U.S. Cl. ..... 4/507; 4/488; 4/506; 138/114

(58) Field of Search ..... 4/488, 506, 507; 52/169.7; 138/114; 248/200.1, 205.4

(56) References Cited

U.S. PATENT DOCUMENTS

| | | | | |
|---|---|---|---|---|
| 3,575,367 A | | 4/1971 | Welsh et al. | |
| 3,859,674 A | | 1/1975 | Thomson | |
| 3,885,742 A | | 5/1975 | Menzel | |
| 4,263,759 A | | 4/1981 | Miller | |
| 4,324,009 A | * | 4/1982 | Hornsby | 4/492 |
| D275,175 S | | 8/1984 | Rolli, Jr. | |
| 4,610,362 A | | 9/1986 | Remp et al. | |
| 4,948,296 A | | 8/1990 | Salter | |
| 5,067,275 A | | 11/1991 | Constance | |
| 5,400,994 A | * | 3/1995 | Shawwaf et al. | 248/354.3 |
| 5,586,352 A | * | 12/1996 | O'Brien et al. | 5/662 |
| 6,421,846 B1 | * | 7/2002 | Shaanan et al. | 4/506 |

* cited by examiner

*Primary Examiner*—Gregory Huson
*Assistant Examiner*—Azy Kokabi
(74) *Attorney, Agent, or Firm*—Donald R. Schoonover

(57) ABSTRACT

The pipes associated with an in-ground swimming pool can be supported by a support that includes a base and two telescopingly engaged tubular sections. A U-shaped element is located on one end of the tubular sections and has a pad on which the pipe rests. A lock connects the two tubular sections together once the height of the support is selected.

2 Claims, 2 Drawing Sheets

SUPPORT FOR IN-GROUND SWIMMING POOL PIPES

BACKGROUND OF THE INVENTION

1. Field of the Invention

The present invention relates to the general art of supports, and to the particular field of conduit supports.

2. Discussion of the Related Art

Many residences and municipalities have in-ground swimming pools. These pools are often installed by professionals according to detailed plans and specifications. The swimming pools are generally installed and then backfilled. Once installed, the pools must be maintained.

The inventor has discovered that, in some instances, the final installation and backfilling of a swimming pool may place stress on the fluid conduits and fittings associated with the swimming pool. Some of these stresses are compounded by shifts in the ground. In some cases, the stresses are sufficient to cause a failure or a rupture in a fluid conduit or a fitting. Such failure may occur long after the swimming pool has been installed. A failure in a fluid conduit or a fitting may require extensive and expensive repair work.

Therefore, there is a need for a means for supporting the fluid conduits and fittings associated with an in-ground swimming pool.

Since in-ground swimming pools can be designed in a wide variety of shapes and sizes and the terrain adjacent to such pools often has a wide variety, any means for supporting the fluid conduits and fittings should be easily adjustable and versatile. In order to save labor costs, such supports should also be easy to set up.

Therefore, there is a need for a means for supporting the fluid conduits and fittings associated with an in-ground swimming pool which is easily set up and is easily adjusted.

Furthermore, since most in-ground swimming pools are intended to last for a long time, any accessory associated with such pools should also be durable.

Therefore, there is a need for a means for supporting the fluid conduits and fittings associated with an in-ground swimming pool which is durable.

PRINCIPAL OBJECTS OF THE INVENTION

It is a main object of the present invention to provide a support for the fluid conduits and fittings associated with an in-ground swimming pool.

It is another object of the present invention to provide a support for the fluid conduits and fittings associated with an in-ground swimming pool that is easily set up.

It is another object of the present invention to provide a support for the fluid conduits and fittings associated with an in-ground swimming pool that is easily adjusted.

It is another object of the present invention to provide a support for the fluid conduits and fittings associated with an in-ground swimming pool that is durable.

SUMMARY OF THE INVENTION

These, and other, objects are achieved by a combination which includes an in-ground swimming pool which includes a plurality of polyvinyl pipes, fittings, backfill, and concrete; a pipe support associated with at least one polyvinyl pipe of the plurality of polyvinyl pipes, the pipe support including a first tubular element having a cylindrical wall, a proximal end, a distal end, an axial dimension extending between the proximal end of the first tubular element and the distal end of the first tubular element, a bore extending along the axial dimension of the first tubular element from the distal end of the first tubular element toward the proximal end of the first tubular element, the bore having an inner diameter, and a slot defined though the cylindrical wall of the first tubular element, a base on the proximal end of the first tubular element, a second tubular element having a cylindrical wall with an outer diameter less than the inner diameter of the bore of the first tubular element, the second tubular element being telescopingly received in the bore of the first tubular element, a lock element on the cylindrical wall of the second tubular element and extending through the slot defined through the cylindrical wall of the first tubular element and frictionally engaging the cylindrical wall of the first tubular element adjacent to the slot defined through the cylindrical wall of the first tubular element to lock the second tubular element to the first tubular element, and a pipe engaging element on the second tubular element, the pipe engaging element including a U-shaped body, an inner surface and a pad on the inner surface of the U-shaped body, the at least one polyvinyl pipe of the plurality of polyvinyl pipes resting on the pad when the at least one polyvinyl pipe is supported by the pipe support.

The pipes associated with the in-ground swimming pool can thus be supported by a support that is easily set up and will reliably hold the pipes during final backfilling of the swimming pool as well as during the pouring of concrete and then after the pool is completed. The supported pipes are less likely to fail than non-supported pipes.

BRIEF DESCRIPTION OF THE DRAWING FIGURES

DETAILED DESCRIPTION OF THE PREFERRED EMBODIMENT

Figure 1:
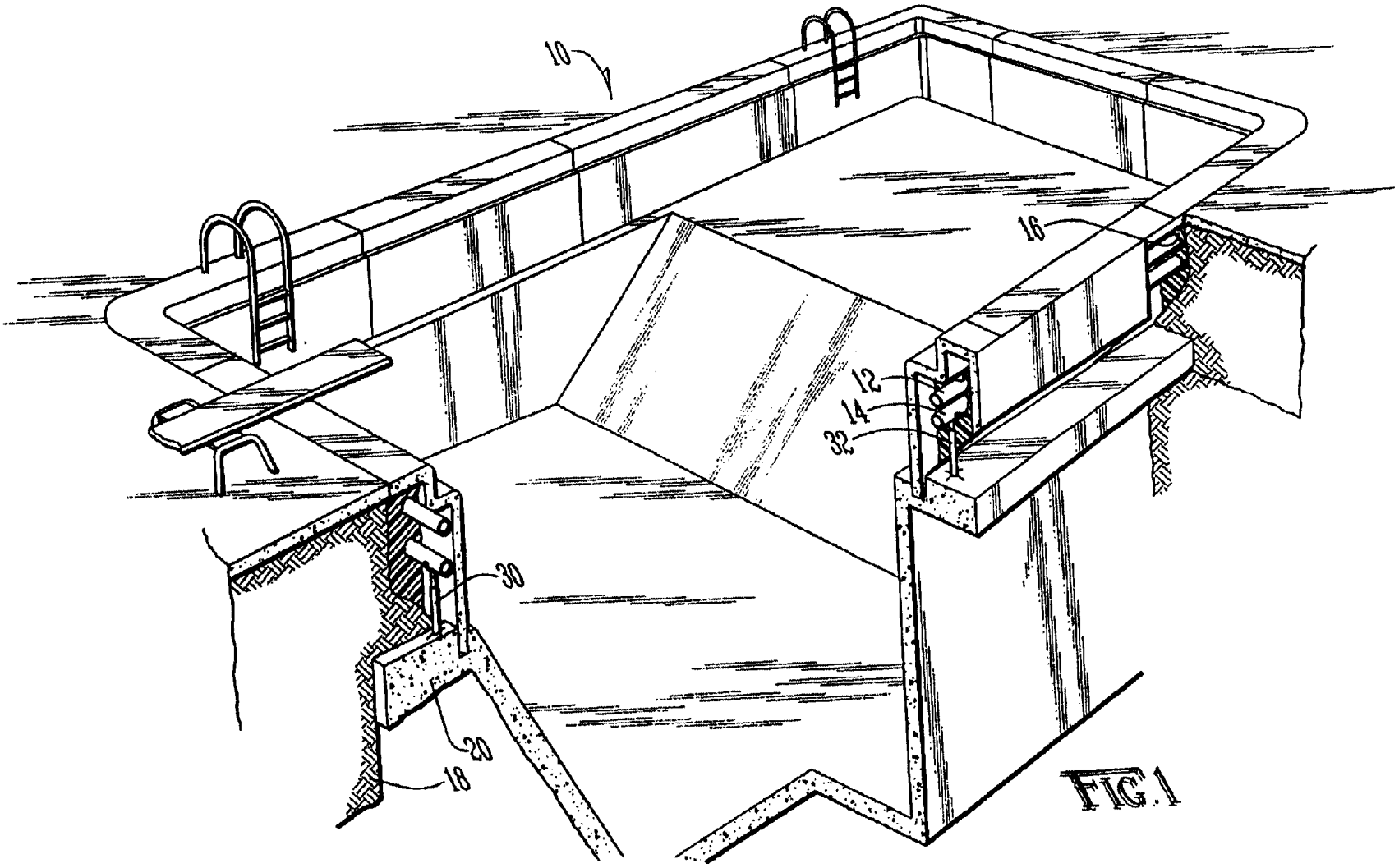
FIG. 1 is a perspective view of an in-ground swimming pool having fluid conduits, fittings and the like, in accordance with the present invention.

Other objects, features and advantages of the invention will become apparent from a consideration of the following detailed description and the accompanying drawings.

Referring to the Figures, it can be understood that the present invention is embodied in a combination that includes an in-ground swimming pool 10 which includes a plurality of polyvinyl pipes, such as pipes 12 and 14 which are used in the manner common to in-ground swimming pools, fittings such as fitting 16, backfill 18, and concrete 20. The operation and functions of the in-ground swimming pool are well known to those skilled in the art and thus will not be discussed herein.

The combination embodying the present invention further includes a pipe support, such as pipe support 30, or pipe support 32, associated with at least one polyvinyl pipe of the plurality of polyvinyl pipes. The pipe support supports the pipes during installation of the pool as well as after installation of the pool. The supported pipes are less likely to fail than other unsupported pipes.

Figure 4:
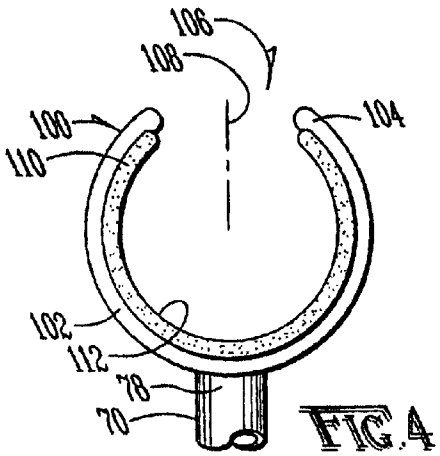
FIG. 4 is a view of detail A shown in FIG. 2, in accordance with the present invention.
Figure 3:
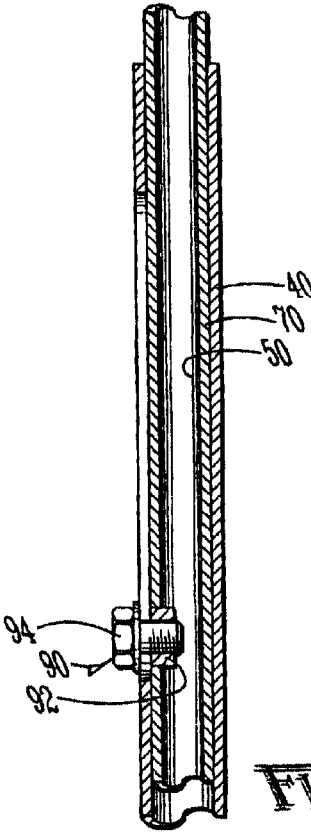
FIG. 3 is an elevational view taken along line 3—3 of FIG. 2.
Figure 2:
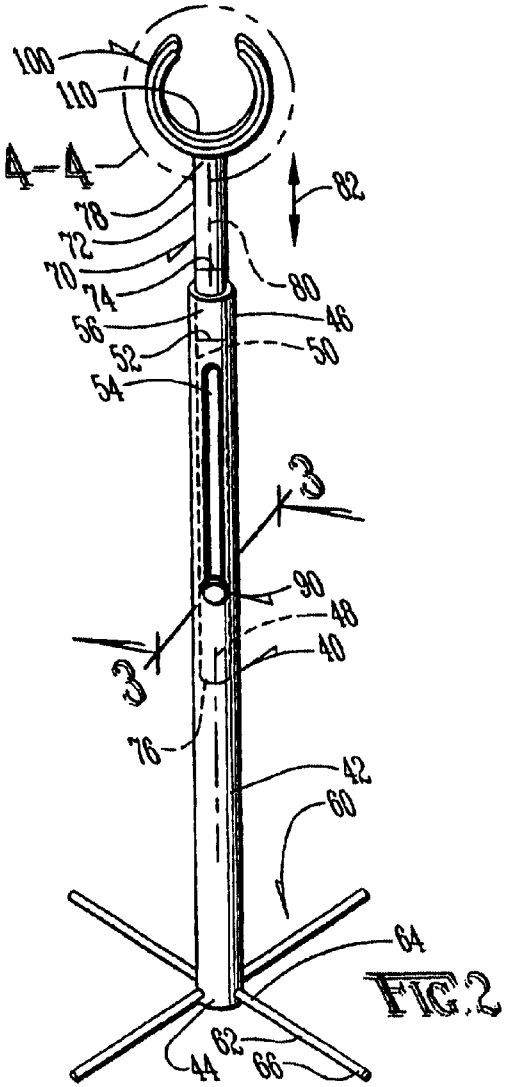
FIG. 2 is a perspective view of a pipe support for use with the in-ground swimming pool shown in FIG. 1.

The pipe support is best shown in FIGS. 2–4 and includes a first tubular element 40 having a cylindrical wall 42, a proximal end 44, a distal end 46 and an axial dimension 48 which extends between the proximal end 44 of the first tubular element 40 and the distal end 46 of the first tubular element 40. A bore 50 is defined in the first tubular element 40 and extends from the distal end 46 of the first tubular element 40 toward the proximal end 44 of the first tubular element 40 in the direction of the axial dimension 48 of the first tubular element 40. The bore 50 has an inner diameter 52. A slot 54 is defined through the cylindrical wall 42 of the first tubular element 40 and has one end 56 thereof located adjacent to and spaced apart from the distal end 46 of the first tubular element 40.

A base 60 is on the proximal end 44 of the first tubular element 40 and has a plurality of support bars, such as support bar 62. Each bar 62 has a proximal end 64 fixed to the cylindrical wall 42 of the first tubular element 40 and extends radially outward from the cylindrical wall 42 of the first tubular element 40, and has a distal end 66 spaced apart from the cylindrical wall 42 of the first tubular element 40.

A second tubular element 70 has a cylindrical wall 72 with an outer diameter 74 that is less than the inner diameter 52 of the bore 50 defined in the first tubular element 40, a proximal end 76, a distal end 78 and an axial dimension 80 that extends between the proximal end 76 of the second tubular element 70 and the distal end 78 of the second tubular element 70.

The second tubular element 70 is telescopingly received in the bore 50 of the first tubular element 40 and is slidable in the direction of the axial dimension 48 of the first tubular element 40 as indicated by double-headed arrow 82. The axial dimension 80 of the second tubular element 70 is co-linear with the axial dimension 48 of the first tubular element 40 when the second tubular element 70 is assembled with the first tubular element 40.

A lock element 90 is threadably mounted on the cylindrical wall 72 of the second tubular element 70 and extends radially outward from the cylindrical wall 72 of the second tubular element 70. The lock element 90 includes a body 92 that extends through the slot 54 defined through the cylindrical wall 42 of the first tubular element 40 and a head 94 that frictionally engages the cylindrical wall 42 of the first tubular element 40 adjacent to the slot 54 to lock the second tubular element 70 to the first tubular element 40.

A pipe-engaging element 100 is located on the distal end 78 of the second tubular element 70. Pipe-engaging element 100 includes a U-shaped body 102 having an inner surface 104 and an opening 106. The U-shaped body 102 is bi-axial with a centerline 108 on the axial dimension 80 of the second tubular element 70. A pad 110 is fixed to the inner surface 104 of the U-shaped body 102. The pad 110 has an inside surface 112 that engages the at least one polyvinyl pipe when the at least one polyvinyl pipe is supported on said pipe support.

The pipe support can be oriented in any direction to properly accommodate a pipe and pad 110 is formed of suitable material so the polyvinyl pipe can be properly supported. The second tubular element 70 is moved with respect to the first tubular element 40 until the pipe support element is positioned at the proper height to stably support a pipe. Then, the lock element 90 is tightened to lock the second tubular element 70 to the first tubular element 40.

It is understood that while certain forms of the present invention have been illustrated and described herein, it is not to be limited to the specific forms or arrangements of parts described and shown.

What is claimed and desired to be covered by Letters Patent is:

1. In combination:

a) an in-ground swimming pool which includes
   (1) a plurality of polyvinyl pipes,
   (2) fittings,
   (3) backfill, and
   (4) concrete; and b) a pipe support associated with at least one polyvinyl pipe of the plurality of polyvinyl pipes, said pipe support including
   (1) a first tubular element having
      (A) a cylindrical wall,
      (B) a proximal end,
      (C) a distal end,
      (D) an axial dimension extending between the proximal end of the first tubular element and the distal end of the first tubular element,
      (E) a bore defined in the first tubular element and extending from the distal end of the first tubular element toward the proximal end of the first tubular element in the direction of the axial dimension of the first tubular element, the bore. having an inner diameter, and
      (F) a slot defined through the cylindrical wall of the first tubular element and having one end thereof located adjacent to and spaced apart from the distal end of the first tubular element,
   (2) a base on the proximal end of the first tubular element and having a plurality of support bars each having a proximal end fixed to the cylindrical wall of the first tubular element and extending radially outward from the cylindrical wall of the first tubular element and having a distal end spaced apart from the cylindrical wall of the first tubular element,
   (3) a second tubular element having
      (A) a cylindrical wall with an outer diameter that is less than the inner diameter of the bore defined in the first tubular element,
      (B) a proximal end,
      (C) a distal end,
      (D) an axial dimension extending between the proximal end of the second tubular element and the distal end of the second tubular element, the second tubular element being telescopingly received in the bore of the first tubular element and being slidable in the direction of the axial dimension of the first tubular element, the axial dimension of the second tubular element being co-linear with the axial dimension of the first tubular element when the second tubular element is assembled with the first tubular element, and
      (E) a lock element threadably mounted on the cylindrical wall of the second tubular element and extending radially outward from the cylindrical wall of the second tubular element, the lock element including a body that extends through the slot defined through the cylindrical wall of the first tubular element and a head that frictionally engages the cylindrical wall of the first tubular element adjacent to the slot to lock the second tubular element to the first tubular element, and
   (4) a pipe engaging element on the distal end of the second tubular element, the pipe engaging element including
      (A) a U-shaped body having an inner surface and an opening, the U-shaped body being bi-axial with a centerline on the axial dimension of the second tubular element, (B) a pad fixed to the inner surface of the U-shaped body, the pad having an inside surface that engages the at least one polyvinyl pipe when the at least one polyvinyl pipe is supported on said pipe support.

2. In combination:

a) an in-ground swimming pool which includes
(1) a plurality of polyvinyl pipes,
(2) fittings,
(3) backfill, and
(4) concrete;

b) a pipe support associated with at least one polyvinyl pipe of the plurality of polyvinyl pipes, said pipe support including
(1) a first tubular element having a cylindrical wall, a proximal end, a distal end, an axial dimension extending between the proximal end of the first tubular element and the distal end of the first tubular element, a bore extending along the axial dimension of the first tubular element from the distal end of the first tubular element toward the proximal end of the first tubular element, the bore having an inner diameter, and a slot defined though the cylindrical wall of the first tubular element,
(2) a base on the proximal end of the first tubular element,
(3) a second tubular element having a cylindrical wall with an outer diameter less than the inner diameter of the bore of the first tubular element, the second tubular element being telescopingly received in the bore of the first tubular element,
(4) a lock element on the cylindrical wall of the second tubular element and extending through the slot defined through the cylindrical wall of the first tubular element and frictionally engaging the cylindrical wall of the first tubular element adjacent to the slot defined through the cylindrical wall of the first tubular element to lock the second tubular element to the first tubular element, and
(5) a pipe engaging element on the second tubular element, the pipe engaging element including a U-shaped body, an inner surface and a pad on the inner surface of the U-shaped body, the at least one polyvinyl pipe of the plurality of polyvinyl pipes resting on the pad when the at least one polyvinyl pipe is supported by said pipe support.

* * * * *